US006093258A

United States Patent [19]

Mc Lean et al.

[11] Patent Number: 6,093,258

[45] Date of Patent: Jul. 25, 2000

[54] TINT STAIN REMOVER

[76] Inventors: Ildiko M. Mc Lean; Michael Mc Lean, both of 23801 Lindley St., Mission Viejo, Calif. 92691

[21] Appl. No.: 09/015,103

[22] Filed: Jan. 29, 1998

[51] Int. Cl.[7] ..... B08B 9/08; B08B 3/04; C11D 3/04; C11D 3/40; C11D 3/50

[52] U.S. Cl. ..... 134/42; 510/101; 510/235; 510/434; 510/477; 510/488

[58] Field of Search ..... 510/101, 336, 510/337, 361, 434, 477, 488, 235; 134/42

[56] References Cited

U.S. PATENT DOCUMENTS

| | | | |
|---|---|---|---|
| 4,083,794 | 4/1978 | Lee et al. | 510/306 |
| 4,269,722 | 5/1981 | Joshi et al. | 510/293 |
| 4,545,919 | 10/1985 | Abel | 8/137 |
| 4,561,991 | 12/1985 | Herbots et al. | 510/281 |
| 4,666,615 | 5/1987 | Disch et al. | 510/419 |
| 5,089,162 | 2/1992 | Rapisarda et al. | 510/101 |
| 5,124,383 | 6/1992 | Obama et al. | 524/115 |
| 5,130,056 | 7/1992 | Jakobson et al. | 510/159 |

*Primary Examiner*—Gregory R. Del Cotto

[57] ABSTRACT

A new tint stain remover for removing tint stains from bottles, bowls, and brushes used daily in the hairdressing trade. The inventive process includes a quantity of salt, a quantity of color additive, a quantity of fragrance, a quantity of citrus, forming a powder out of the salt, color additive, fragrance, and citrus, measuring out one teaspoon of the powder and placing within a tinted bowl and adding water to the tinted bowl.

1 Claim, No Drawings

TINT STAIN REMOVER

BACKGROUND OF TITLE INVENTION

1. Field of the Invention

The present invention relates to detergent mixtures and more particularly pertains to a new tint stain remover for removing tint stains from bottles, bowls, and brushes used daily in the hairdressing trade.

2. Description of the Prior Art

The use of detergent mixtures is known in the prior art. More specifically, detergent mixtures heretofore devised and utilized are known to consist basically of familiar, expected and obvious structural configurations, notwithstanding the myriad of designs encompassed by the crowded prior art which have been developed for the fulfillment of countless objectives and requirements.

Known prior art detergent mixtures include U.S. Pat. No. 4,545,919 to Abel; U.S. Pat. No. 5,130,056 to Jakobson et al.; U.S. Pat. No. 4,666,615 to Disch et al.; U.S. Pat. No. 4,083,794 to Lee et al.; U.S. Pat. No. 5,124,383 to Obama et al.; and U.S. Pat. No. Des. 291,392 to Worthen.

While these devices fulfill their respective, particular objectives and requirements, the aforementioned patents do not disclose a new tint stain remover. The inventive device includes a quantity of salt, a quantity of color additive, a quantity of fragrance, a quantity of citrus, forming a powder out of the salt, color additive, fragrance, and citrus, measuring out one teaspoon of the powder and placing within a tinted bowl and adding water to the tinted bowl.

In these respects, the tint stain remover according to the present invention substantially departs from the conventional concepts and designs of the prior art, and in so doing provides an apparatus primarily developed for the purpose of removing tint stains from bottles, bowls, and brushes used daily in the hairdressing trade.

SUMMARY OF THE INVENTION

In view of the foregoing disadvantages inherent in the known types of detergent mixtures now present in the prior art, the present invention provides a new tint stain remover construction wherein the same can be utilized for removing tint stains from bottles, bowls, and brushes used daily in the hairdressing trade.

The general purpose of the present invention, which will be described subsequently in greater detail, is to provide a new tint stain remover apparatus and method which has many of the advantages of the detergent mixtures mentioned heretofore and many novel features that result in a new tint stain remover which is not anticipated, rendered obvious, suggested, or even implied by any of the prior art detergent mixtures, either alone or in any combination thereof.

To attain this, the present invention generally comprises a quantity of salt, a quantity of color additive, a quantity of fragrance, a quantity of citrus, forming a powder out of the salt, color additive, fragrance, and citrus, measuring out one teaspoon of the powder and placing within a tinted bowl and adding water to the tinted bowl.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tint stain remover apparatus and method which has many of the advantages of the detergent mixtures mentioned heretofore and many novel features that result in a new tint stain remover which is not anticipated, rendered obvious, suggested, or even implied by any of the prior art detergent mixtures, either alone or in any combination thereof.

It is another object of the present invention to provide a new tint stain remover which may be easily and efficiently manufactured and marketed.

It is a further object of the present invention to provide a new tint stain remover which is of a durable and reliable construction.

An even further object of the present invention is to provide a new tint stain remover which is susceptible of a low cost of manufacture with regard to both materials and labor, and which accordingly is then susceptible of low prices of sale to the consuming public, thereby making such tint stain remover economically available to the buying public.

Still yet another object of the present invention is to provide a new tint stain remover which provides in the apparatuses and methods of the prior art some of the advantages thereof, while simultaneously overcoming some of the disadvantages normally associated therewith.

Still another object of the present invention is to provide a new tint stain remover for removing tint stains from bottles, bowls, and brushes used daily in the hairdressing trade.

Yet another object of the present invention is to provide a new tint stain remover which includes a quantity of salt, a quantity of color additive, a quantity of fragrance, a quantity of citrus, forming a powder out of the salt, color additive, fragrance, and citrus, measuring out one teaspoon of the powder and placing within a tinted bowl and adding water to the tinted bowl.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the descriptive matter.

DESCRIPTION OF THE PREFERRED EMBODIMENT

A new tint stain remover embodying the principles and concepts of the present invention will be described. The tint stain remover includes a quantity of salt, a quantity of color additive, a quantity of fragrance, a quantity of citrus, forming a powder out of the salt, color additive, fragrance, and citrus, measuring out one teaspoon of the powder and placing within a tinted bowl and adding water to the tinted bowl.

In use, the user would simply pour one teaspoon of the powder into a tinted bottle or bowl, or onto a hairbrush's bristles. Water would be added, and the contents would be shaken and rinsed. The present invention would quickly and effectively remove stains from hair dyes and tints on bowls, bottles, and brushes. This product would provide hair stylists with a fast and effective cleaning agent.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for removing tint stains from a bottle or bowl used in the hairdressing trade for tinting hair, consisting of providing a quantity of salt;

providing a quantity of color additive;

providing a quantity of fragrance;

providing a quantity of citrus;

mixing the salt, color additive, fragrance, and citrus together;

forming a powder out of the salt, color additive, fragrance, and citrus;

measuring out one teaspoon of the powder and placing the powder in the bottle or bowl having a tint stain;

adding water to the powder in the bottle or bowl having a tint stain shaking the bottle or bowl; and rinsing the bottle or bowl.

* * * * *